US006941936B2

(12) United States Patent
Yasui et al.

(10) Patent No.: US 6,941,936 B2
(45) Date of Patent: Sep. 13, 2005

(54) CONTROL SYSTEM FOR INTERNAL COMBUSTION ENGINE

(75) Inventors: Yuji Yasui, Wako (JP); Yoshihisa Iwaki, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 310 days.

(21) Appl. No.: 10/269,990

(22) Filed: Oct. 15, 2002

(65) Prior Publication Data

US 2003/0070667 A1 Apr. 17, 2003

(30) Foreign Application Priority Data

Oct. 16, 2001 (JP) ..... 2001-317907

(51) Int. Cl.[7] ..... F02D 41/14
(52) U.S. Cl. ..... 123/674; 123/690; 701/109
(58) Field of Search ..... 123/674, 688, 123/690, 698; 701/109, 114

(56) References Cited

U.S. PATENT DOCUMENTS

| | | | | |
|---|---|---|---|---|
| 5,710,578 A | * | 1/1998 | Beauregard et al. | 345/441 |
| 6,449,943 B1 | * | 9/2002 | Ueno et al. | 60/274 |
| 2003/0089357 A1 | * | 5/2003 | Takizawa et al. | 123/674 |

FOREIGN PATENT DOCUMENTS

| | | |
|---|---|---|
| DE | 198 55 495 A1 | 1/1998 |
| JP | 63173838 A | 7/1988 |
| JP | 7-180615 | 7/1995 |
| JP | 2576481 | 11/1996 |

* cited by examiner

*Primary Examiner*—Tony M. Argenbright
(74) *Attorney, Agent, or Firm*—Squire, Sanders & Dempsey L.L.P.

(57) ABSTRACT

A control system for an internal combustion engine having at least one control device that affects an air-fuel ratio of an air-fuel mixture to be supplied to the engine, is disclosed. An air-fuel ratio correction coefficient is calculated for correcting an amount of fuel to be supplied to the engine so that the detected air-fuel ratio coincides with a target air-fuel ratio. An air-fuel ratio affecting parameter indicative of a degree of influence that an operation of the control device exercises upon the air-fuel ratio, is calculated. A correlation parameter which defines a correlation between the air-fuel ratio correction coefficient and the air-fuel ratio affecting parameter is calculated using a sequential statistical processing algorithm. A learning correction coefficient relating to a change in characteristics of the control device is calculated using the correlation parameter. The air-fuel ratio is controlled using the air-fuel ratio correction coefficient and the learning correction coefficient.

21 Claims, 5 Drawing Sheets

CONTROL SYSTEM FOR INTERNAL COMBUSTION ENGINE

BACKGROUND OF THE INVENTION

The present invention relates to a control system for an internal combustion engine, and more particularly to a control system having a control device such as an exhaust gas recirculation mechanism or an evaporative fuel processing system, that affects the air-fuel ratio of an air-fuel mixture to be supplied to the internal combustion engine. In this specification, the control device that affects the air-fuel ratio is referred to as "A/F affecting control device".

An exhaust gas recirculation mechanism for recirculating exhaust gases from an exhaust system of an internal combustion engine to an intake system thereof, is widely used for improving exhaust characteristics of the engine. An evaporative fuel processing system in which a canister containing an adsorbent stores evaporative fuel generated in a fuel tank to supply the evaporative fuel to the intake system during operation of the engine, is also widely used for preventing emission of the evaporative fuel to the atmosphere. A control device such as the exhaust gas recirculation mechanism or the evaporative fuel processing system, affects the air-fuel ratio of an air-fuel mixture to be supplied to the engine. Accordingly, in some instances an abnormality such as clog or a leak in an exhaust gas recirculation passage or an evaporative fuel passage, may have an adverse effect on the air-fuel ratio control.

The recent tightening of emission regulations (harmful gas emission) has highlighted that the amount of exhaust gases to be recirculated to the intake system or the amount of evaporative fuel to be supplied to the intake system changes due to a clog or similar abnormality in the exhaust gas recirculation passage or the evaporative fuel passage. Such changes have an adverse effect on the exhaust characteristics of the engine.

One example of a method for determining an abnormality such as a clog in an exhaust gas recirculation passage is described in Japanese Patent Laid-open No. Hei 7-180615. According to this method for determining an abnormality, an intake pressure at an open position of an exhaust gas recirculation valve and an intake pressure in a closed position of the exhaust gas recirculation valve are measured during engine operation when the fuel supply to the engine is cut off. If the difference between these intake pressures is smaller than a predetermined value, the exhaust gas recirculation mechanism is judged as abnormal because there is a clog or a leak in the exhaust gas recirculation passage.

Further, a method of correcting an air-fuel ratio with an air-fuel ratio control system is known from Japanese Patent No. 2576481. The air-fuel ratio control system includes an air-fuel ratio sensor provided in an exhaust system of an internal combustion engine. An air-fuel ratio correction coefficient is calculated according to an output from the air-fuel ratio sensor to control the air-fuel ratio of an air-fuel mixture to be supplied to the engine so that it becomes equal to a target air-fuel ratio. According to this method, a learning correction value is calculated by using the air-fuel ratio correction coefficient during execution of exhaust gas recirculation, and a deviation of the air-fuel ratio due to aging is corrected by using the learning correction value.

The method for determining an abnormality as described in Japanese Patent Laid-open No. 7-180615, mentioned above, is executed in the fuel-cut operation of the engine, which is a very narrow and limited operating condition.

Accordingly, there is a limit to increasing the frequency of the determination and it is difficult to do so.

On the other hand, in the above method described in Japanese Patent No. 2576481, the learning correction value is calculated by a simple averaging of air-fuel ratio correction coefficients regardless of changes in the engine operating condition and in the exhaust gas recirculation amount. Accordingly, it is difficult to obtain an accurate learning correction value that is applicable over a wide range of engine operating conditions.

BRIEF SUMMARY OF THE INVENTION

A first object of the present invention is to provide a control system for an internal combustion engine, which can obtain an accurate learning correction value that corresponds to a deterioration in an A/F affecting control device, and is applicable over a wide range of the engine operating conditions, thereby improving the control accuracy of the air-fuel ratio.

A second object of the present invention is to provide a control system for an internal combustion engine, which can accurately determine an abnormality in an A/F affecting control device in a wide range of engine operating conditions.

To achieve the first object, the present invention provides a control system for an internal combustion engine having at least one control device including either an exhaust gas recirculation mechanism, or an evaporative fuel processing system that affects an air-fuel ratio of an air-fuel mixture to be supplied to the engine. The control system includes an air-fuel ratio sensor provided in an exhaust system of the engine, air-fuel ratio correction coefficient calculating means, air-fuel ratio affecting parameter calculating means, correlation parameter calculating means, learning means, and air-fuel ratio controlling means. The air-fuel ratio correction coefficient calculating means calculates an air-fuel ratio correction coefficient (KAF) for correcting an amount of fuel to be supplied to the engine so that the air-fuel ratio detected by the air-fuel ratio sensor coincides with a target air-fuel ratio. The air-fuel ratio affecting parameter calculating means calculates an air-fuel ratio affecting parameter (Qx) indicative of a degree of influence that an operation of the control device exercises upon the air-fuel ratio. The correlation parameter calculating means calculates at least one correlation parameter (A, B) which defines a correlation between the air-fuel ratio correction coefficient (KAF) and the air-fuel ratio affecting parameter (Qx), using a sequential statistical processing algorithm. The learning means calculates a learning correction coefficient (KREFQ) relating to a change in characteristics of the control device, using the correlation parameter (A, B). The air-fuel ratio controlling means controls the air-fuel ratio, using the air-fuel ratio correction coefficient (KAF) and the learning correction coefficient (KREFQ).

With this configuration, the air-fuel ratio affecting parameter, indicative of a degree of influence that the operation of the control device exercises upon the air-fuel ratio, is calculated. At least one correlation parameter, defining the correlation between the air-fuel ratio affecting parameter calculated above and the air-fuel ratio correction coefficient set according to the detected air-fuel ratio, is calculated using the sequential statistical processing algorithm. Further, the learning correction coefficient relating to a change in characteristics of the control device is calculated using the correlation parameter calculated above. Accordingly, the learning correction coefficient can be obtained accurately according to a change in characteristics of the A/F affecting control device over a wide range of engine operating conditions. Further, the air-fuel ratio is controlled by using the air-fuel ratio correction coefficient and the learning correction coefficient, which makes it possible to maintain good control. In addition, since the sequential statistical processing algorithm is used, no special computing device for the statistical processing, such as a CPU, is required and the computation of the statistical processing can be executed with a relatively small memory capacity.

Preferably, the control system further includes abnormality determining means for determining an abnormality in the control device according to the correlation parameter (A).

With this configuration, an abnormality in the control device is determined according to the correlation parameter. Accordingly, the operation of the A/F affecting control device is always monitored to increase the frequency of the abnormality determination and improve the accuracy of the determination.

Preferably, the correlation parameter calculating means calculates the correlation parameter (A, B), when the engine is operating in a predetermined operating condition.

With this configuration, the correlation parameter is calculated when the engine is operating in the predetermined operating condition. Accordingly, the correlation parameter is calculated accurately to improve the accuracy of the learning correction.

Preferably, the correlation parameter calculating means calculates a modified air-fuel ratio correction coefficient (KAFMOD) by modifying the air-fuel ratio correction coefficient (KAF) with the learning correction coefficient (KREFQ), and calculates the correlation parameter (A, B), using the modified air-fuel ratio correction coefficient (KAFMOD).

With this configuration, the air-fuel ratio correction coefficient is modified by the learning correction coefficient to thereby calculate the modified air-fuel ratio correction coefficient. Then, the correlation parameter is calculated using the modified air-fuel ratio correction coefficient instead of the air-fuel ratio correction coefficient. If the air-fuel ratio correction coefficient is itself used, there is a possibility that the learning control by the learning correction coefficient may result in a hunting condition. Such a problem can be avoided by using the modified air-fuel ratio correction coefficient. The hunting condition is an attempt to establish the learning correction coefficient in order to calculate the correlation parameter.

Preferably, the correlation parameter calculating means calculates the correlation parameter (A, B), using a deviation (KAF−1) between the air-fuel ratio correction coefficient (KAF) and a central value of the air-fuel ratio correction coefficient.

With this configuration, the deviation between the air-fuel ratio correction coefficient and a central value of the air-fuel ratio correction coefficient is used instead of only the air-fuel ratio correction coefficient, to calculate the correlation parameter. The deviation varies around zero which is the center of variation range. Accordingly, the correlation parameter can be obtained with a higher degree of accuracy, when using the sequential statistical processing algorithm.

Preferably, the correlation parameter calculating means uses the sequential statistical processing algorithm, limiting a value of the correlation parameter (A, B) within a predetermined range. Accordingly, a stable correlation parameter can be obtained.

To achieve the second object, the present invention provides a control system for an internal combustion engine having at least one control device that affects an air-fuel ratio of an air-fuel mixture to be supplied to the engine. The control system includes an air-fuel ratio sensor provided in an exhaust system of the engine, air-fuel ratio correction coefficient calculating means, air-fuel ratio affecting parameter calculating means, correlation parameter calculating means, and abnormality determining means. The air-fuel ratio correction coefficient calculating means calculates an air-fuel ratio correction coefficient (KAF) for correcting an amount of fuel to be supplied to the engine so that the air-fuel ratio detected by the air-fuel ratio sensor coincides with a target air-fuel ratio. The air-fuel ratio affecting parameter calculating means calculates an air-fuel ratio affecting parameter (Qx) indicative of a degree of influence that an operation of the control device exercises upon the air-fuel ratio. The correlation parameter calculating means calculates at least one correlation parameter (A, B) which defines a correlation between the air-fuel ratio correction coefficient (KAF) and the air-fuel ratio affecting parameter (Ox), using a sequential statistical processing algorithm. The abnormality determining means determines an abnormality in the control device according to the correlation parameter (A, B).

With this configuration, the air-fuel ratio affecting parameter indicative of a degree of influence that the operation of the control device exercises upon the air-fuel ratio, is calculated. The correlation parameter defining the correlation between the air-fuel ratio affecting parameter calculated above and the air-fuel ratio correction coefficient set according to the detected air-fuel ratio, is calculated using the sequential statistical processing algorithm. Further, the abnormality in the control device is determined according to the correlation parameter. As a result, the determination of abnormality in the A/F affecting control device can be performed accurately during normal engine operating conditions.

DETAILED DESCRIPTION OF THE INVENTION

Some embodiments of the present invention will now be described with reference to the drawings.

First Embodiment

Figure 1:
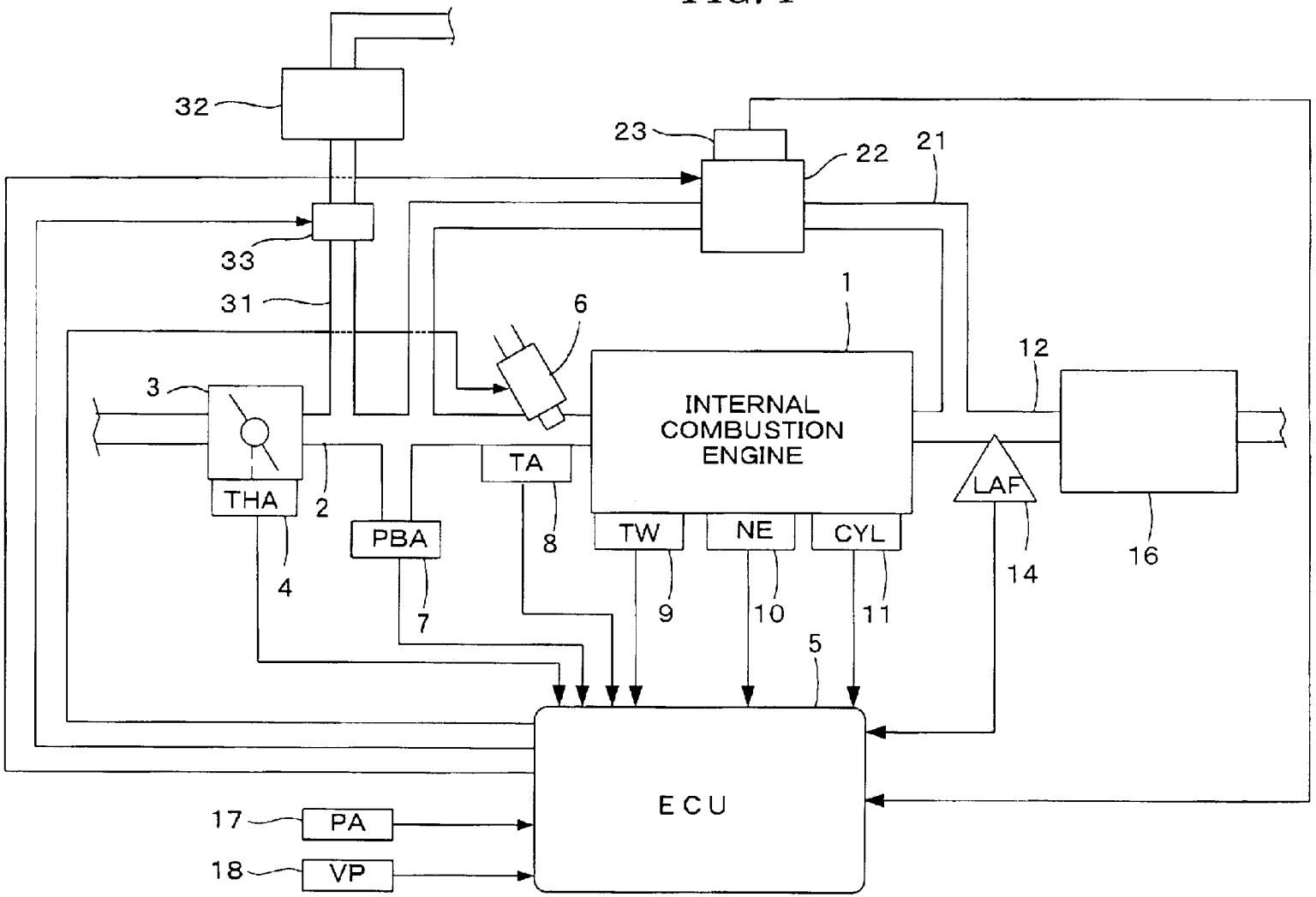
FIG. 1 is a diagram showing the configuration of an internal combustion engine and a control system therefor according to a first embodiment of the present invention.

FIG. 1 illustrates a general configuration of an internal combustion engine (engine) and a control system therefor according to a first embodiment of the present invention. The engine can be a four-cylinder engine 1, for example, having an intake pipe 2 provided with a throttle valve 3. A throttle opening sensor (THA) 4 can be connected to the throttle valve 3, so as to output an electrical signal when the throttle valve 3 opens and supply the electrical signal to an electronic control unit (ECU) 5.

Fuel injection valves 6, only one of which is shown, are inserted into the intake pipe 2 at locations intermediate between the cylinder block of the engine 1 and the throttle valve 3 and slightly upstream of the respective intake valves (not shown). The fuel injection valves 6 can be connected to a fuel pump (not shown), and electrically connected to the ECU 5. A valve opening period of each fuel injection valve 6 can be controlled by a signal output from the ECU 5.

An absolute intake pressure sensor (PBA) 7 is provided immediately downstream of the throttle valve 3. An absolute pressure signal converted to an electrical signal by the absolute intake pressure sensor 7, is supplied to the ECU 5. An intake air temperature sensor (TA) 8 can be provided downstream of the absolute intake pressure sensor 7 to detect an intake air temperature TA. An electrical signal corresponding to the detected intake air temperature TA, is output from the sensor 8 and supplied to the ECU 5.

An engine coolant temperature sensor (TW) 9 such as a thermistor can be mounted on the body of the engine 1 to detect an engine coolant temperature (cooling water temperature) TW. A temperature signal corresponding to the detected engine coolant temperature TW is output from the sensor 9 and supplied to the ECU 5.

An engine rotational speed sensor (NE) 10 and a cylinder discrimination sensor (CYL) 11 can be mounted to face a camshaft or a crankshaft (both not shown) of the engine 1. The engine rotational speed sensor 10 outputs a top dead center (TDC) signal pulse at a crank angle position located at a predetermined crank angle before the top dead center corresponding to the start of an intake stroke of each cylinder of the engine 1 (at every 180° crank angle in the case of a four-cylinder engine). The cylinder discrimination sensor 11 outputs a cylinder discrimination signal pulse at a predetermined crank angle position for a specific cylinder of the engine 1. The sensors 10 and 11 supply signal pulses to the ECU 5.

An exhaust pipe 12 of the engine 1 can be provided with a three-way catalyst 16 for reducing NOx, HC, and CO contained in exhaust gases. A proportional type air-fuel ratio sensor (LAF sensor) 14 can be mounted on the exhaust pipe 12 at a position upstream of the three-way catalyst 16. The LAF sensor 14 outputs an electrical signal substantially proportional to the oxygen concentration (air-fuel ratio) in the exhaust gases, and supplies the electrical signal to the ECU 5.

An exhaust gas recirculation passage 21 can be connected between a portion of the intake pipe 2 downstream of the throttle valve 3 and a portion of the exhaust pipe 12 upstream of the three-way catalyst 16. The exhaust gas recirculation passage 21 can be provided with an exhaust gas recirculation valve (EGR valve) 22 for controlling an exhaust gas recirculation amount. The EGR valve 22 can be an electromagnetic valve having a solenoid, and its valve opening degree can be controlled by the ECU 5. The EGR valve 22 can be provided with a lift sensor 23 for detecting the valve opening degree (valve lift amount) LACT of the EGR valve 22, and a detection signal from the lift sensor 23 is supplied to the ECU 5. The exhaust gas recirculation passage 21 and the EGR valve 22 constitute an exhaust gas recirculation mechanism.

A canister 32 can be connected to a fuel tank (not shown) to store evaporative fuel generated inside the fuel tank. The canister 32 contains, for example, an adsorbent for adsorbing the evaporative fuel. The canister 32 can be connected through a purging passage 31 to the intake pipe 2 at a position downstream of the throttle valve 3. The purging passage 31 can be provided with a purge control valve 33. The purge control valve 33 can be a solenoid valve capable of continuously controlling the flow rate by changing the on-off duty ratio of a received control signal. The ECU 5 controls the operation of the purge control valve 33. Alternatively, a solenoid valve whose valve opening degree is continuously variable may provide the purge control valve 33. In this case, the above-mentioned on-off duty ratio corresponds to the valve opening degree in such a continuously variable valve opening type solenoid valve. The purging passage 31, the canister 32, and the purge control valve 33 constitute an evaporative fuel processing system.

In this embodiment, the exhaust gas recirculation mechanism and the evaporative fuel processing system correspond to the A/F affecting control devices.

An atmospheric pressure sensor 17 and a vehicle speed sensor 18 can be connected to the ECU 5. Detection signals from these sensors 17 and 18 are supplied to the ECU 5.

The ECU 5 includes an input circuit having various functions including shaping the waveforms of input signals from the various sensors, correcting the voltage levels of the input signals to a predetermined level, and converting analog signal values into digital signal values. The ECU 5 can further include a central processing unit (CPU), a memory circuit, and an output circuit. The memory circuit preliminarily stores various operational programs to be executed by the CPU and stores the results of the computation or the like by the CPU. The output circuit supplies drive signals to the fuel injection valves 6, the EGR valve 22, and the purge control valve 33.

The ECU 5 determines various engine operating conditions according to the output signals from the sensors mentioned above to supply a control signal to the solenoid of the EGR valve 22. Specifically, the ECU 5 can set a valve lift command value LCMD according to the engine rotational speed NE and the absolute intake pressure PBA, and can control the EGR valve 22 so that a deviation between the valve lift command value LCMD and an actual valve lift amount LACT detected by the lift sensor 23, becomes zero.

The CPU in the ECU 5 determines various engine operating conditions according to the output signals from the sensors mentioned above, and computes a fuel injection period TOUT of each fuel injection valve 6 to be opened in synchronism with the TDC signal pulse. The fuel injection period TOUT is calculated from Eq. (1) described below, according to the above determined engine operating conditions.

$$TOUT = TIM \times KAF \times KREFQ \times KEGR \times KPURGE \times K1 + K2 \quad (1)$$

where:

TIM is a basic fuel injection period of each fuel injection valve 6;

KAF is an air-fuel ratio correction coefficient;

KREFQ is a learning correction coefficient;

KEGR is an EGR correction coefficient;

KPURGE is a purge correction coefficient;

K1 is another correction coefficient; and

K2 is a correction variable.

The basic fuel injection period TIM is determined by retrieving a TI map that can be set according to the engine rotational speed NE and the absolute intake pressure PBA. The TI map can be set so that the air-fuel ratio of an air-fuel mixture to be supplied to the engine 1 becomes substantially equal to the stoichiometric ratio during operation according to the engine rotational speed NE and the absolute intake pressure PBA on the map.

KAF can be set so that the air-fuel ratio detected by the LAF sensor 14 coincides with a target air-fuel ratio. When the feedback control according to the output from the LAF sensor 14 is not performed, the air-fuel ratio correction coefficient KAF can be set to "1.0".

KREFQ can be introduced to compensate for a deviation in the feedback control by the air-fuel ratio correction coefficient KAF. The learning correction coefficient KREFQ is effective when the control characteristics of the exhaust gas recirculation amount and the purge flow rate are different from the preliminarily assumed average characteristics. This difference between the control characteristics and the preliminarily assumed average characteristics is due to characteristic differences in mass-produced exhaust gas recirculation mechanisms and evaporative fuel processing systems, or aging of the exhaust gas recirculation mechanism and the evaporative fuel processing system. A specific calculation method for this coefficient will be hereinafter described.

In order to decrease a fuel injection amount (by decreasing intake air amount), KEGR can be set to "1.0" (a noncorrection value) when exhaust gas recirculation is not occurring, for example, when the EGR valve 22 is closed. Alternatively, KEGR can be set to a value smaller than "1.0" when exhaust gas recirculation is occurring, for example, when the EGR valve 22 is opened.

KPURGE can be set to "1.0" when the purge control valve 33 is closed, or set to a value smaller than "1.0" when the purge control valve 33 is opened to supply the evaporative fuel to the intake pipe 2. An increase in amount of the evaporative fuel supplied decreases the fuel injection amount.

The correction coefficient K1 and the correction variable K2 are determined so as to optimize various characteristics such as fuel consumption and engine acceleration according to engine operating conditions.

The CPU supplies a drive signal for opening each fuel injection valve 6 according to the fuel injection period TOUT obtained above.

This embodiment employs a new calculation method for the learning correction coefficient KREFQ which is applied to Eq. (1). This calculation method will now be described.

Figure 2:
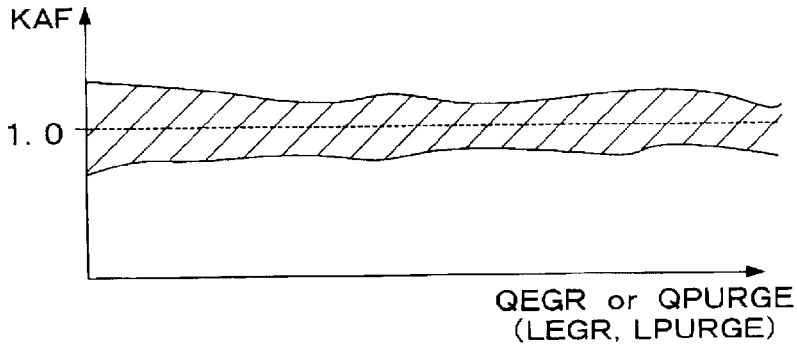
FIG. 2 is a graph showing the relation between an air-fuel ratio correction coefficient (KAF) and an exhaust gas recirculation amount (QEGR) or a purge flow rate (QPURGE) in a normal condition.

When the exhaust gas recirculation mechanism or the evaporative fuel processing system is normal (not deteriorated), the relation between an exhaust gas recirculation amount QEGR or a purge flow rate QPURGE, and an air-fuel ratio correction coefficient KAF, is shown in FIG. 2. In FIG. 2, the hatched region indicates a range of values of the air-fuel ratio correction coefficient KAF corresponding to the exhaust gas recirculation amount QEGR or the purge flow rate QPURGE. As illustrated in FIG. 2, the air-fuel ratio correction coefficient KAF is maintained at a substantially constant value in the vicinity of "1.0" irrespective of changes in the exhaust gas recirculation amount QEGR or the purge flow rate QPURGE. The exhaust gas recirculation amount QEGR or the purge flow rate QPURGE shown in FIG. 2 is not an actual flow rate, but an estimated flow rate which can be calculated according to the valve opening degree of the EGR valve 22 or the purge control valve 33. The actual exhaust gas recirculation amount and the actual purge flow rate will be referred to as "QEGRA" and "QPURGEA", respectively, to distinguish from the estimated exhaust gas recirculation amount QEGR and the estimated purge flow rate QPURGE.

When the exhaust gas recirculation passage 21 or the purging passage 31 are completely or partially clogged, thereby reducing the flow rate, the actual exhaust gas recirculation amount QEGRA or the actual purge flow rate QPURGEA decreases. Accordingly, the EGR correction coefficient KEGR which can be calculated according to the actual valve lift LACT of the EGR valve 22, or the purge correction coefficient KPURGE which can be calculated according to the valve opening duty of the purge control valve 33, becomes smaller than a value corresponding to the actual exhaust gas recirculation amount QEGRA or the actual purge flow rate QPURGEA (i.e., a value that makes no change in the air-fuel ratio). Therefore, the air-fuel ratio shifts from a target value toward a lean region, and the air-fuel ratio correction coefficient KAF increases to compensate for this shift. As a result, a positive correlation characteristic shown in FIG. 3 can be obtained. That is, the air-fuel ratio correction coefficient KAF tends to increase with an increase in the exhaust gas recirculation amount QEGR or the purge flow rate QPURGE. Further, as illustrated by the upward inclination toward the right in this positive correlation characteristic, the slope of the positive correlation characteristic increases with an increase in the degree of clogging.

On the other hand, when there is a leak instead of a clog, the outside air enters the exhaust gas recirculation passage 21 or the purging passage 31, so that the exhaust gas recirculation amount or the purge flow rate decreases, similar to when these passages are clogged. Accordingly, the air-fuel ratio shifts toward the lean region as though there was a clog. As a result, the air-fuel ratio correction coefficient KAF tends to increase with an increase in the exhaust gas recirculation amount QEGR or the purge flow rate QPURGE. Further, as illustrated by the upward inclination toward the right in this positive correlation characteristic, the slope of the positive correlation characteristic increases with an increase in the degree of leakage.

Figure 3:
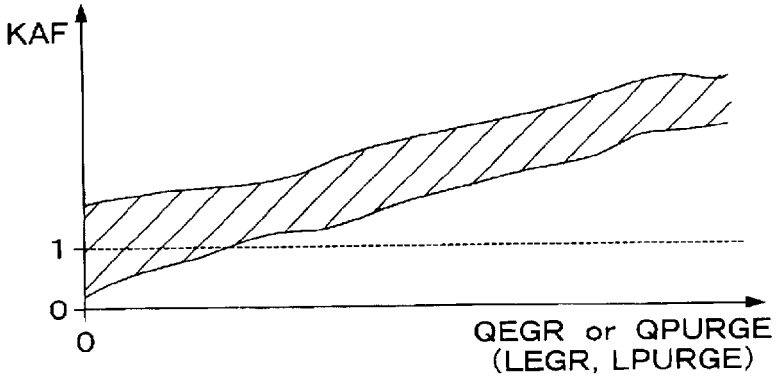
FIG. 3 is a graph showing the relation between the air-fuel ratio correction coefficient (KAF) and the exhaust gas recirculation amount (QEGR) or the purge flow rate (QPURGE) in an abnormal condition.

The exhaust gas recirculation amount QEGR or the purge flow rate QPURGE represented by the horizontal axis in each of FIGS. 2 and 3 may be replaced by a valve lift parameter LEGR (either, a valve lift command value LCMD or actual valve lift amount LACT) of the EGR valve 22, or a valve lift parameter LPURGE (either, a valve opening duty or an actual valve lift) of the purge control valve 33. Also in this case, a similar correlation characteristic can be obtained. These parameters QEGR, QPURGE, LEGR, and LPURGE will generally be hereinafter referred to as "air-fuel ratio affecting parameter Qx".

The correlation characteristic between the air-fuel ratio affecting parameter Qx and the air-fuel ratio correction coefficient KAF reflects not only an abnormality such as a clog or a leak in the exhaust gas recirculation mechanism or the evaporative fuel processing system, but also a deviation in the EGR correction coefficient KEGR and/or the purge correction coefficient KPURGE due to characteristic variations in mass-produced exhaust gas recirculation mechanisms or evaporative fuel processing systems. Accordingly, by calculating the learning correction coefficient KREFQ according to this correlation characteristic and applying the learning correction coefficient KREFQ to Eq. (1), it is possible to compensate for not only a deterioration such as a clog or a leak in the exhaust gas recirculation mechanism or the evaporative fuel processing system, but also an effect of characteristic variations in mass-produced exhaust gas recirculation mechanisms or the evaporative fuel processing systems.

In view of the above described points, an abnormality in the exhaust gas recirculation mechanism or the evaporative fuel processing system is determined according to the correlation characteristic between the air-fuel ratio affecting parameter Qx and the air-fuel ratio correction coefficient KAF. Further, the learning correction coefficient KREFQ can be calculated according to the correlation characteristic between the air-fuel ratio affecting parameter Qx and the air-fuel ratio correction coefficient KAF. The air-fuel ratio can be suitably corrected using the learning correction coefficient KREFQ which can be calculated according to a degree of deterioration that is judged as normal. Moreover, using the learning correction coefficient KREFQ compensates the effect of characteristic variations in mass-produced exhaust gas recirculation mechanisms or evaporative fuel processing systems.

Figure 4:
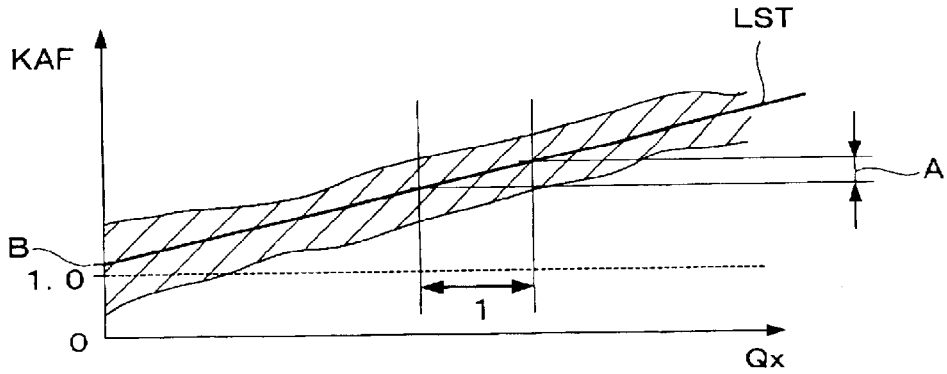
FIG. 4 is a graph showing the relation between the air-fuel ratio correction coefficient (KAF) and an air-fuel ratio affecting parameter (Qx)

The correlation characteristic shown in FIG. 3 can be approximated by an expression corresponding to a straight line LST shown in FIG. 4. That is, the correlation characteristic can be defined by Eq. (2) shown below.

$$KAF(k)=A\times Qx(k-d)+B \tag{2}$$

where:

A and B are correlation parameters defining the correlation characteristic;

"k" is a discrete time digitized with a control period; and

"d" is a dead time period until the air-fuel ratio correction coefficient KAF reflects a change in the exhaust gas recirculation amount or the purge flow rate.

Correlation parameters A and B are calculated by the least square method. Specifically, the correlation parameter A can correspond to a slope of the straight line LST, and the correlation parameter B can correspond to the air-fuel ratio correction coefficient KAF when the air-fuel ratio affecting parameter Qx equals "0" as shown in FIG. 4. The dead time period d can correspond to a delay time period from the time the exhaust gas recirculation amount or the purge flow rate changes, to the time the air-fuel correction coefficient KAF changes.

In general, when using the least square method, a large amount of data on the air-fuel ratio affecting parameter Qx(k) and the air-fuel ratio correction coefficient KAF(k) are required to calculate the correlation parameters A and B with a high accuracy. Accordingly, a large amount of data for computation of the correlation parameters must be stored in a memory.

Further, an inverse matrix computation is required to execute the least square method. As a result, the computation time period determined by the computing capacity of the CPU for the engine control can be lengthy. This causes a problem in that the required computation cannot be finished while the vehicle is running (during engine operation). Likewise, other computations for the engine control cannot be executed. Although the above-noted problems may be avoided by providing an additional CPU dedicated to the inverse matrix computation, the manufacturing cost of the engine control unit may greatly increase.

Therefore, in this embodiment, a sequential identification algorithm, which is used for the adaptive control or the system identification, can be employed to calculate the correlation parameters A and B. The sequential identification algorithm can be an algorithm using a recurrence formula. Specifically, the sequential identification algorithm can be an algorithm for calculating present values A(k) and B(k) of the correlation parameters, according to present values (the latest values) Qx(k) and KAF(k) of the processing object data obtained in time series, and preceding values A(k−1) and B(k−1) of the correlation parameters.

When a correlation parameter vector θ(k) including the correlation parameters A and B as elements is defined by Eq. (3) shown below, the correlation parameter vector θ(k) is calculated from Eq. (4) shown below according to the sequential identification algorithm.

$$\theta(k)^T=[A(k)B(k)] \tag{3}$$

$$\theta(k)=\theta(k-1)+KP(k)\times eid(k) \tag{4}$$

where eid(k) is an identification error defined by Eqs. (5) and (6) shown below, and KP(k) is a gain coefficient vector defined by Eq. (7) shown below. P(k) in Eq. (7) is a second-order square matrix calculated from Eq. (8) shown below.

$$eid(k)=KAF(k)-\theta(k-1)^T\zeta(k) \tag{5}$$

$$\zeta^T(k)=[Qx(k-d)1] \tag{6}$$

$$KP(k)=\frac{P(k)\zeta(k)}{1+\zeta^T(k)P(k)\zeta(k)} \tag{7}$$

$$P(k+1)=\frac{1}{\lambda 1}\left(E-\frac{\lambda 2P(K)\zeta(k)\zeta^T(k)}{\lambda 1+\lambda 2\zeta^T(k)P(k)\zeta(k)}\right)P(k) \tag{8}$$

where E is a unit matrix.

In accordance with the setting of coefficients λ1 and λ2 in Eq. (8), the identification algorithm from Eqs. (4) to (8) becomes one of the following four identification algorithms:

λ1=1, λ2=0 Fixed gain algorithm

λ1=1, λ2=1 Method-of-least-squares algorithm

λ1=1, λ2=λ Degressive gain algorithm (λ takes a given value other than "0" and "1")

λ1=λ, λ2=1 Method-of-weighted-least-squares algorithm (λ takes a given value other than "0" and "1")

In this embodiment, the method-of-weighted-least-squares algorithm may be employed by setting the coefficient λ1 to a predetermined value λ falling between "0" and "1", and setting the coefficient λ2 to "1". Any one of the other algorithms may be adopted. Among these algorithms, the method-of-least-squares algorithm and the method-of-weighted-least-squares algorithm are suitable for the statistical processing.

According to the sequential identification algorithm of Eqs. (4) to (8), the inverse matrix computation is not required. However, the inverse matrix computation is required for the batch operation type least square method mentioned above. The values to be stored in the memory are only A(k), B(k), and P(k) (2×2 matrix). Accordingly, by using the sequential weighted least square method, the statistical processing operation can be simplified, and performed by the engine control CPU without using any special CPU for the statistical processing operation.

In the sequential weighted least square method, the correlation parameters can be calculated with higher accuracy by making the center of variations in the parameters (ζ, KAF) equal "0". The center of variations in the parameters is relevant to the calculation of the identification error eid. Therefore, the identification error eid(k) in this embodiment is calculated from Eq. (5a) shown below instead of Eq. (5).

$$eid(k)=(KAF(k)-1)-\theta(k-1)^T\zeta(k) \quad (5a)$$

By using Eq. (5a), the computation for obtaining the straight line LST shown in FIG. 4 is converted into the computation for obtaining a straight line LSTa shown in FIG. 5. As apparent from FIG. 5, the center of variations in the parameter (KAF(k)−1) becomes "0", so that the correlation parameters A and B can be obtained with a higher accuracy.

Further, the correlation parameters A and B can be calculated more stably by limiting the values of the correlation parameters A(k) and B(k) so as to satisfy Eqs. (9) and (10) shown below.

$$AL<A(k)<AH \quad (9)$$

$$BL<B(k)<BH \quad (10)$$

where AL and AH are the lower limit and the upper limit of the correlation parameter A(k), respectively, and BL and BH are the lower limit and the upper limit of the correlation parameter B(k), respectively.

Determining an abnormality in the exhaust gas recirculation mechanism or the evaporative fuel processing system, using the correlation parameters will now be described.

Figure 6A:
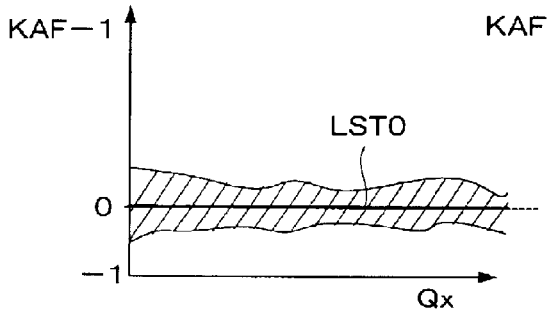
FIGS. 6A and 6B are graphs showing the relation between the parameter (KAF−1) and the air-fuel ratio affecting parameter (Qx) in a normal condition and in an abnormal condition, respectively.
Figure 6B:
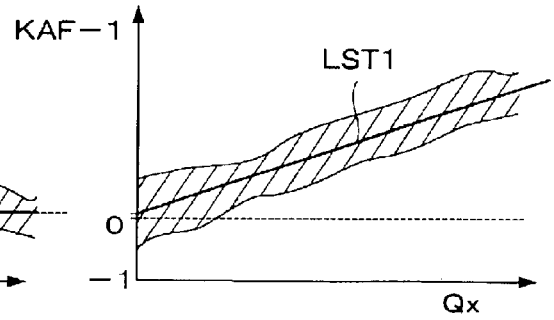

When the exhaust gas recirculation mechanism or the evaporative fuel processing system is normal, a correlation characteristic as shown in FIG. 6A is obtained. In contrast, when the exhaust gas recirculation mechanism or the evaporative fuel processing system is abnormal, for example, when the degree of clogging or leakage becomes large, a correlation characteristic as shown in FIG. 6B is obtained. That is, the slope A of a straight line LST0 shown in FIG. 6A changes, so that the straight line LST0 changes to a straight line LST1 shown in FIG. 6B. Accordingly, if the correlation parameter A(k) calculated by the above method is less than a determination threshold XQXNG (A(k)<XQXNG), it is determined that the exhaust gas recirculation mechanism or the evaporative fuel processing system is normal. If the correlation parameter A(k) is greater than or equal to the determination threshold XQXNG (A(k) XQXNG), it is determined that the exhaust gas recirculation mechanism or the evaporative fuel processing system is abnormal. The determination threshold XQXNG can be experimentally set to a suitable value.

The calculation method for the learning correction coefficient KREFQ will now be described.

Figure 5:
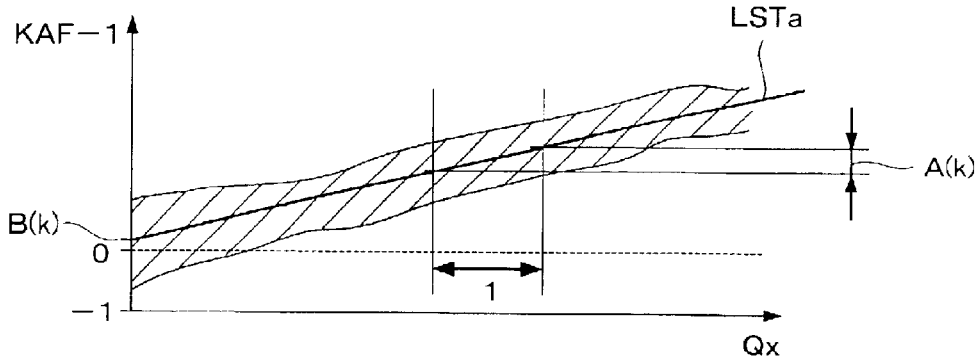
FIG. 5 is a graph showing the relation between a parameter (KAF−1) depending on the air-fuel ratio correction coefficient and the air-fuel ratio affecting parameter (Qx)

The straight line LSTa shown in FIG. 5 is expressed by Eq. (11) shown below.

$$KAF-1=A(k)\times Qx+B(k) \quad (11)$$

Eq. (11) is modified to Eq. (12) shown below.

$$KAF=A(k)\times Qx+B(k)+1 \quad (12)$$

Eq. (12) indicates the correlation characteristic between the air-fuel ratio affecting parameter Qx and the air-fuel ratio correction coefficient KAF as obtained by statistical processing, because the correlation parameters A(k) and B(k) are calculated by the weighted least square method. Accordingly, a statistically-estimated air-fuel ratio correction coefficient KAFE can be obtained from the right side of Eq. (12), when the air-fuel ratio affecting parameter Qx is given. Then, by defining this statistically-estimated air-fuel ratio correction coefficient KAFE as a learning correction coefficient KREFQ, the learning correction coefficient KREFQ can be calculated from Eq. (12a) shown below.

$$KREFQ=A(k)\times Qx(k)+B(k)+1 \quad (12a)$$

By applying this learning correction coefficient KREFQ to Eq. (1) to calculate the fuel injection period TOUT, compensation by the air-fuel ratio correction coefficient KAF becomes unnecessary, even when the exhaust gas recirculation mechanism or the evaporative fuel processing system is deteriorated, such as when there is a clog or a leak. Accordingly, the air-fuel ratio correction coefficient KAF can be maintained at a value near "1.0" like the case where the exhaust gas recirculation mechanism or the evaporative fuel processing system is normal. As such, it is possible to prevent a deviation of the center of the air-fuel ratio feedback control.

However, when the learning correction coefficient KREFQ calculated from Eq. (12a) is applied to Eq. (1), the following hunting of control occurs.

(1) The slope of the straight line LST increases from "0" (the correlation parameter A(k) increases).

(2) The learning correction coefficient KREFQ increases from "1.0".

(3) The correlation parameter A(k) decreases to near "0".

(4) The learning correction coefficient KREFQ returns to "1.0" (the slope of the straight line LST returns to "0").

(1) The slope of the straight line LST increases from "0" (the correlation parameter A(k) increases).

To prevent this hunting, the air-fuel ratio correction coefficient KAF is not used for the calculation of the correlation parameters A(k) and B(k). Rather, a modified air-fuel ratio correction coefficient KAFMOD(k) calculated from Eq. (13) shown below is used.

$$KAFMOD(k)=KAF(k)\times KREFQ(k-d) \quad (13)$$

Eq. (13) is obtained by counting the dead time period d until a change in air-fuel ratio in the intake system due to an increase in the learning correction coefficient KREFQ is reflected by the LAF sensor 14 to the air-fuel ratio correction coefficient KAF.

Figure 7:
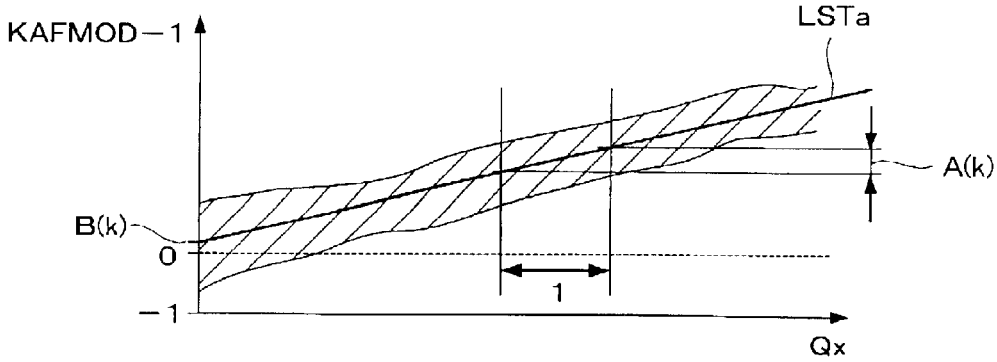
FIG. 7 is a graph showing the relation between a parameter (KAFMOD−1) depending on a modified air-fuel ratio correction coefficient and the air-fuel ratio affecting parameter (Qx)

By adopting Eq. (11a) shown below instead of Eq. (11), the correlation parameters A(k) and B(k) determining the correlation between a parameter (KAFMOD−1) and the air-fuel ratio affecting parameter Qx can be calculated by the sequential least square method mentioned above. Specifically, the correlation parameters A(k) and B(k) defining a straight line LSTa shown in FIG. 7 can be calculated.

$$KAFMOD-1=A(k)\times Qx+B(k) \quad (11a)$$

In this case, Eq. (5b) shown below is used instead of Eq. (5a) to calculate the identification error eid(k). Then, by using Eq. (5b) and Eqs. (4) and (6) to (8), the correlation parameter vector θ(k) is calculated.

$$eid(k)=(KAFMOD(k)-1)-\theta(k-1)^T\zeta(k) \quad (5b)$$

In this manner, the correlation parameters A(k) and B(k) determining the correlation characteristic between the air-fuel ratio affecting parameter Qx and the parameter (KAFMOD−1) are first calculated, and the learning correction coefficient KREFQ is next calculated from Eq. (12a) shown below.

$$KREFQ=A(k)\times Qx+B(k)+1 \quad (12a)$$

Accordingly, the learning correction coefficient KREFQ can be obtained with a higher accuracy, without resulting in an attempt to establish control (without the hunting of control). By applying the learning correction coefficient KREFQ, thus obtained, to Eq. (1), the control accuracy of the air-fuel ratio can be improved to thereby maintain good exhaust characteristics.

Figure 8:
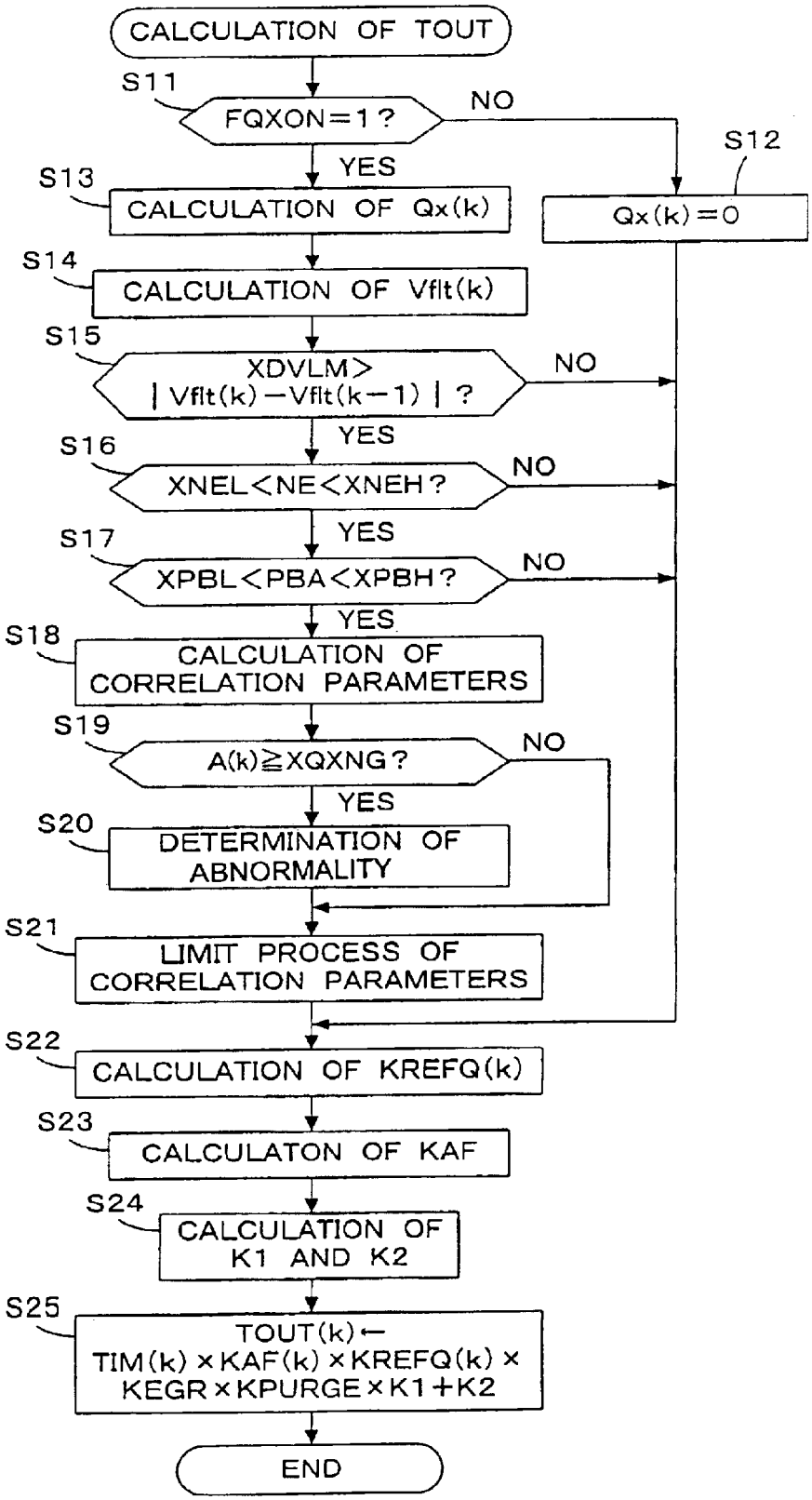
FIG. 8 is a flowchart showing a process for calculating a fuel injection period (TOUT)

FIG. 8 illustrates a flowchart showing a process for calculating the correlation parameters A(k) and B(k) to calculate the learning correction coefficient KREFQ using the above-described method, and calculating the fuel injection period TOUT using the calculated learning correction coefficient KREFQ. Further, this process includes the determination of abnormality in the exhaust gas recirculation mechanism or the evaporative fuel processing system according to the correlation parameter A(k). The process shown in FIG. 8 can be executed by the CPU in the ECU 5 in synchronism with the generation of a TDC signal pulse.

In step S11, it is determined whether or not an air-fuel ratio affecting flag FQXON is "1". The air-fuel ratio affecting flag FQXON can be set to "1", when either the exhaust gas recirculation and/or the evaporative fuel purging from the canister 32 to the intake pipe 2 of the engine 1 are performed. If the flag FQXON is "0", the air-fuel ratio affecting parameter Qx(k) can be set to "0" (step S12), and the process proceeds directly to step S22.

If the air-fuel ratio affecting flag FQXON is "1", the air-fuel ratio affecting parameter Qx(k) is calculated (step S13).

In this embodiment, a situation where both the exhaust gas recirculation and the evaporative fuel purging are performed is contemplated. The exhaust gas recirculation amount QEGR and the purge flow rate QPURGE are respectively converted into parameters TQEGR and TQPURGE each indicating the degree of influence on the air-fuel ratio. The parameters TQEGR and TQPURGE will be hereinafter referred to as "EGR affecting parameter TQEGR" and "purge affecting parameter TQPURGE", respectively. These parameters TQEGR and TQPURGE are added together to calculate the air-fuel ratio affecting parameter Qx(k) from Eq. (15) shown below.

$$Qx(k)=TQEGR+TQ\mathrm{PURGE} \quad (15)$$

The EGR affecting parameter TQEGR and the purge affecting parameter TQPURGE are respectively defined by Eqs. (16) and (17) using the EGR correction coefficient KEGR and the purge correction coefficient KPURGE that are applied to Eq. (1).

$$TQEGR=1-KEGR \quad (16)$$

$$TQ\mathrm{PURGE}=1-K\mathrm{PURGE} \quad (17)$$

The EGR correction coefficient KEGR in Eq. (16) is calculated from Eq. (18) shown below.

$$KEGR=1-(1-KEGR\mathrm{MAP})\times(LACT/LCMD)\times(KQEGR2/KQEGR1) \quad (18)$$

where KEGRMAP is a map value read from a map preliminarily set according to the engine rotational speed NE and the absolute intake pressure PBA. LACT and LCMD are the actual valve lift amount and the valve lift command value of the EGR valve 22, respectively. KQEGR1 is a first coefficient value calculated according to the difference between a reference atmospheric pressure PA0 (=101.3 kPa) and the absolute intake pressure PBA. KQEGR2 is a second coefficient value calculated according to the difference between a detected atmospheric pressure PA and the absolute intake pressure PBA. The first and second coefficient values KQEGR1 and KQEGR2 are used to compensate for the influence due to a change in the atmospheric pressure PA.

The purge correction coefficient KPURGE is calculated from Eqs. (19) to (21) shown below.

$$QF=CPG\times Q\mathrm{PURGE} \quad (19)$$

$$TQF=QF\times KQT/NE \quad (20)$$

$$K\mathrm{PURGE}=1-TQF/TIM \quad (21)$$

where QPURGE in Eq. (19) is a purge flow rate (estimated flow rate) calculated according to the valve opening duty of the purge control valve 33 and the difference between the atmospheric pressure PA and the absolute intake pressure PBA. CPG in Eq. (19) is a concentration of evaporative fuel in the purged air-fuel mixture purged from the canister 32 to the intake pipe 2. The concentration CPG can be calculated according to an estimated value QVPCANI of an amount of evaporative fuel stored in the canister 32. Accordingly, an evaporative fuel amount QF to be supplied to the intake pipe 2 per unit time can be calculated from Eq. (19)

TQF calculated from Eq. (20) is a fuel injection period converted value obtained by converting the evaporative fuel amount QF into the fuel injection period of the fuel injection valve 6. KQT is a conversion coefficient set to a constant value, and NE is an engine rotational speed. Accordingly, by applying this converted value TQF to Eq. (21), the purge correction coefficient KPURGE is obtained. TIM in Eq. (21) is the basic fuel injection period used in Eq. (1).

The purge flow rate QPURGE is preferably calculated by applying a map value QPG to Eq. (22) shown below. The map value QPG can be calculated according to a valve opening duty of the purge control valve 33 and the difference between the atmospheric pressure PA and the absolute intake pressure PBA. Eq. (22) is used, since a change in the actual purge flow rate is delayed from a change in the valve opening duty of the purge control valve 33.

$$Q\mathrm{PURGE}=CQPGV\times QPG+(1-CQPGV)\times Q\mathrm{PURGE}(k-1) \quad (22)$$

where CQPGV is a first-order lag coefficient which can be set to a value between "0" and "1", and QPURGE(k−1) is a preceding calculated value of the purge flow rate.

Thus, the air-fuel ratio affecting parameter Qx(k) is calculated in step S13.

In step S14, the detected vehicle speed VP is subjected to a low-pass filtering process to calculate a vehicle speed filtered value Vflt(k) from Eq. (23) shown below.

$$Vflt(k)=af1\cdot Vflt(k)+\ldots+afn\cdot Vflt(k-n)+bf0\cdot Vf0t(k)+\ldots+bfm\cdot Vflt(k-m) \quad (23)$$

where af1 to afn and bf0 to bfm are the predetermined low-pass filter coefficients.

In step S15, it is determined whether or not the absolute value of the difference between a present value Vflt(k) and a preceding value Vflt(k−1) of the vehicle speed filtered value, is less than a predetermined vehicle speed change amount XDVLM (e.g., 0.8 km/h). If the answer to step S15 is negative (NO), the process proceeds to step S22. If the answer to step S15 is affirmative (YES), it is determined whether or not the engine rotational speed NE falls within the range of a predetermined upper limit XNEH (e.g., 4500 rpm) and a predetermined lower limit XNEL (e.g., 1200 rpm) (step S16). If the answer to step S16 is negative (NO), the process proceeds to step S22. If the answer to step S16 is affirmative (YES), it is then determined whether or not the absolute intake pressure PBA falls within the range of a predetermined upper limit XPBH (e.g., 86.7 kPa (650 mmHg)) and a predetermined lower limit XPBL (e.g., 54.7 kPa (410 mmHg)) (step S17). If the answer to step S17 is negative (NO), the process proceeds to step S33. If the answer to step S17 is affirmative (YES), the correlation parameter vector θ(k) (the correlation parameters A(k) and B(k)) is calculated from Eqs. (4), (5b), (6) to (8), and (11a).

In step S19, it is determined whether or not the correlation parameter A(k) is greater than or equal to a determination threshold XQXNG. If A(k) is less than XQXNG, the process proceeds directly to step S21. If A(k) is greater than or equal to XQXNG, it is determined that the exhaust gas recirculation mechanism or the evaporative fuel processing system is abnormal (step S20). In this case, an alarm lamp is turned on to give an alarm to the driver of the vehicle.

In step S21, a limit process is executed so that the correlation parameters A(k) and B(k) satisfy Eqs. (9) and (10), respectively. That is, if Eq. (9) and/or Eq. (10) are not satisfied, the correlation parameter A(k) and/or the correlation parameter B(k) are modified so as to satisfy Eq. (9) and/or Eq. (10).

In step S22, the learning correction coefficient KREFQ is calculated from Eq. (12a).

In step S23, the air-fuel ratio correction coefficient KAF is calculated by the air-fuel ratio feedback control according to an output from the LAF sensor 14. That is, the air-fuel ratio correction coefficient KAF is calculated so that the detected air-fuel ratio coincides with the target air-fuel ratio.

In step S24, the other correction coefficient K1 and the correction variable K2 to be applied to Eq. (1) are calculated. Finally, the fuel injection period TOUT is calculated from Eq. (1) (step S25).

According to this embodiment as described above, the air-fuel ratio affecting parameter Qx indicates a degree of influence that the operation of the exhaust gas recirculation mechanism and the evaporative fuel processing system exercises upon the air-fuel ratio is calculated. Further, the correlation parameters A(k) and B(k) defining the correlation between the air-fuel ratio correction coefficient KAF and the air-fuel ratio affecting parameter Qx are calculated using the sequential statistical processing algorithm. By means of the sequential statistical processing algorithm, no special CPU for the statistical processing is required, and the correlation parameters A(k) and B(k) can be calculated by the statistical processing computation with a relatively small memory capacity.

Since the learning correction coefficient KREFQ is calculated using the correlation parameters A(k) and B(k), the learning correction coefficient KREFQ depending on changes in characteristics of the A/F affecting control devices (the exhaust gas recirculation mechanism and/or the evaporative fuel processing system), can be obtained with a higher degree of accuracy over a wide range of the engine operating condition. Further, since the fuel injection period TOUT is calculated using the air-fuel ratio correction coefficient KAF and the learning correction coefficient KREFQ, the control center of the air-fuel ratio correction coefficient KAF can be maintained at a value near "1.0", thereby maintaining good control.

Further, since the determination of an abnormality in the exhaust gas recirculation mechanism and/or the evaporative fuel processing system is performed according to the correlation parameter A(k), the abnormality determination can be accurately performed during a normal engine operation.

Further, the correlation parameters A(k) and B(k) can be calculated during operation when variations in the vehicle speed are small, and the engine rotational speed NE and the absolute intake pressure PBA fall within the respective ranges of the predetermined upper limits and the predetermined lower limits. Accordingly, the accuracy of the correlation parameters can be improved to thereby further improve the accuracy of the learning correction.

In this embodiment, the ECU 5 constitutes the air-fuel ratio correction coefficient calculating means, the air-fuel ratio affecting parameter calculating means, the correlation parameter calculating means, the learning means, the air-fuel ratio controlling means, and the abnormality determining means. More specifically, step S23 in FIG. 8 corresponds to the air-fuel ratio correction coefficient calculating means. Step S13 in FIG. 8 corresponds to the air-fuel ratio affecting parameter calculating means. Step S18 in FIG. 8 corresponds to the correlation parameter calculating means. Step S22 in FIG. 8 corresponds to the learning means. Step S25 in FIG. 8 corresponds to the air-fuel ratio controlling means. Steps S19 and S20 in FIG. 8 correspond to the abnormality determining means.

Modification of the First Embodiment

In the above embodiment, the air-fuel ratio affecting parameter Qx can be calculated as a sum of the EGR affecting parameter TQEGR and the purge affecting parameter TQPURGE when any one or both of the exhaust gas recirculation mechanism and the evaporative fuel processing system are operating (for example, when either the exhaust gas recirculation and/or the evaporative fuel purging are performed), and the correlation parameters A(k) and B(k) are calculated using the air-fuel ratio affecting parameter Qx calculated above. Alternatively, the exhaust gas recirculation amount QEGR, or the actual valve lift amount LACT or the valve lift command value LCMD of the EGR valve may be used as the air-fuel ratio affecting parameter Qx to calculate first correlation parameters A1(k) and B1(k), and the purge flow rate QPURGE or the valve opening duty of the purge control valve may be used as the air-fuel ratio affecting parameter Qx to calculate second correlation parameters A2(k) and B2(k). In this case, since an influence of the fuel concentration CPG of the purged air-fuel mixture can be large during operation of the evaporative fuel processing system, a parameter (CPG×QPURGE) is preferably used as the air-fuel ratio affecting parameter Qx during operation of the evaporative fuel processing system. When calculating the first and second correlation parameters, as mentioned above, the accuracy of calculation of each correlation parameter can be further improved by calculating each correlation parameter when only one A/F affecting control device having an influence upon the correlation parameters being calculated, is operating. In other words, to improve the accuracy of calculation it is preferable to calculate the first correlation parameter A1(k) and B1(k), when the exhaust gas recirculation mechanism is operating and the evaporative fuel processing system is not operating, and to calculate the second correlation parameter A2(k) and B2(k), when the exhaust gas recirculation mechanism is not operating and the evaporative fuel processing system is operating.

In this modification, a first learning correction coefficient KREFQ1 can be calculated according to the first correlation parameters A1(k) and B1(k), and a second learning correction coefficient KREFQ2 can be calculated according to the second correlation parameters A2(k) and B2(k). The first and second learning correction coefficient KREFQ1 and KREFQ2 are applied to Eq. (1). Further, the determination of an abnormality in the exhaust gas recirculation mechanism can be performed according to the first correlation parameter A1(k), and the determination of an abnormality in the evaporative fuel processing system can be performed according to the second correlation parameter A2(k).

Second Embodiment

Figure 9:
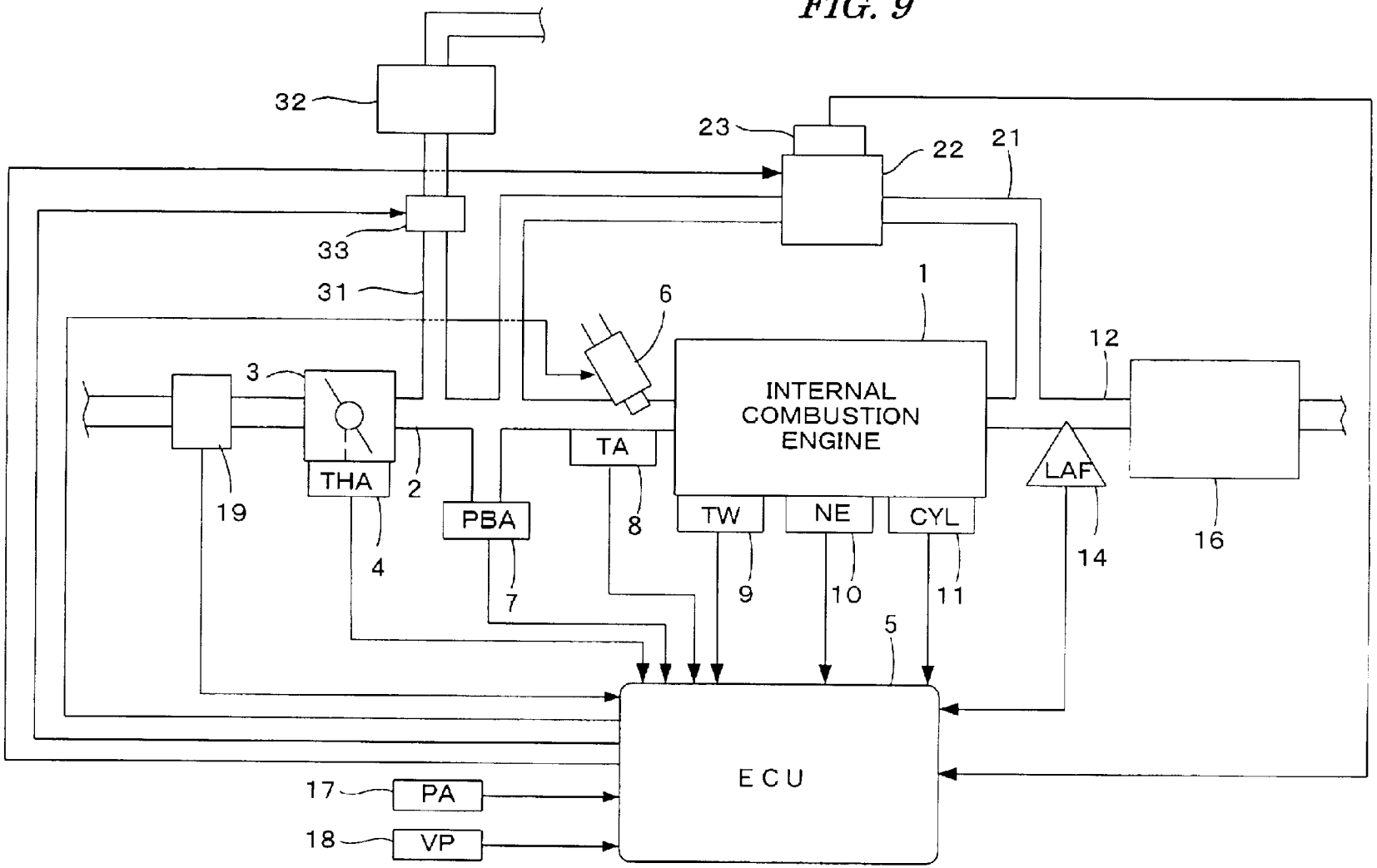
FIG. 9 is a diagram showing the configuration of an internal combustion engine and a control system therefor according to a second embodiment of the present invention.

FIG. 9 illustrates a schematic diagram showing the configuration of an internal combustion engine and a control system therefor according to a second embodiment of the present invention. In this embodiment, the intake pipe 2 can be provided with an air flow sensor 19 for detecting an intake air flow rate QAIR.

In this embodiment, the basic fuel injection period TIM can be set according to the intake air flow rate QAIR detected by the air flow sensor 19 so that the air-fuel ratio becomes equal to the stoichiometric ratio. When performing the exhaust gas recirculation, the intake air flow rate QAIR detected by the air flow sensor 19 decreases by an amount corresponding to the exhaust gas recirculation amount QEGR, and the basic fuel injection period TIM can be set according to such a decreased intake air flow rate QAIR. Accordingly, the EGR correction coefficient KEGR is not necessary.

That is, the fuel injection period TOUT is calculated from Eq. (1a) shown below in this embodiment.

$$TOUT=TIM\times KAF\times KREFQ\times KPURGE\times K1+K2 \quad (1a)$$

In this embodiment, a parameter (1−KPURGE) or the product of the fuel concentration CPG and the purge flow rate QPURGE can be used as the air-fuel ratio affecting parameter Qx.

Other Embodiments

In the above-described embodiments, the correlation characteristic between the air-fuel ratio affecting parameter Qx and the parameter (KAFMOD−1) is approximated by a straight line. Alternatively, the correlation characteristic may be approximated by a quadratic curve rather than a straight line. In this case, the correlation characteristic is approximated by Eq. (24) shown below.

$$KAFMOD-1=A(k)Qx^2+B(k)Qx+C(k) \quad (24)$$

where the slope F of this approximate curve is given by Eq. (25) shown below.

$$F=2A(k)Qx+B(k) \quad (25)$$

When the correlation characteristic is approximated by the quadratic curve, the slope of this curve increases if the exhaust gas recirculation passage or the purging passage is abnormal. Accordingly, if the slope F (=2A(k)QxM+B(k)) is greater than or equal to a predetermined threshold when the air-fuel ratio affecting parameter Qx equals an average value QxM, it may be determined that the exhaust gas recirculation passage or the purging passage is abnormal.

Further, in the above-described embodiment, it is determined whether or not the amount of change in the filtered value Vflt of the vehicle speed VP is less than the predetermined vehicle speed change amount XDVLM in step S15 shown in FIG. 8. Alternatively, it may be determined whether or not an amount of change in a low-pass filtered value of the engine rotational speed NE is less than a predetermined change amount, and/or it may be determined whether or not an amount of change in a low-pass filtered value of the absolute intake pressure PBA is less than a predetermined change amount.

In this case, the process shown in FIG. 8 proceeds from step S15 to step S16 if the degree of change in the low-pass filtered value of the engine rotational speed NE is less than the predetermined change amount. Likewise, the process shown in FIG. 8 proceeds from step S15 to step S16, if the amount of change in the low-pass filtered value of the absolute intake pressure PBA is less than the predetermined change amount, or if the amount of change in the low-pass filtered value of the engine rotational speed NE is less than the predetermined change amount and the amount of change in the low-pass filtered value of the absolute intake pressure PBA is less than the predetermined change amount.

The present invention may be embodied in other specific forms without departing from the spirit or essential characteristics thereof. The presently disclosed embodiments are therefore to be considered in all respects as illustrative and not restrictive, the scope of-the invention being indicated by the appended claims, rather than the foregoing description, and all changes which come within the meaning and range of equivalency of the claims are, therefore, to be embraced therein.

What is claimed is:

1. A control system for an internal combustion engine having at least one control device that affects an air-fuel ratio of an air-fuel mixture to be supplied to said engine, said control system comprising:

an air-fuel ratio sensor provided in an exhaust system of said engine;

air-fuel ratio correction coefficient calculating means for calculating an air-fuel ratio correction coefficient for correcting an amount of fuel to be supplied to said engine so that the air-fuel ratio detected by said air-fuel ratio sensor coincides with a target air-fuel ratio;

air-fuel ratio affecting parameter calculating means for calculating an air-fuel ratio affecting parameter indicative of a degree of influence that an operation of said at least one control device exercises upon the air-fuel ratio;

correlation parameter calculating means for calculating at least one correlation parameter which defines a correlation between the air-fuel ratio correction coefficient and the air-fuel ratio affecting parameter using a sequential statistical processing algorithm;

learning means for calculating a learning correction coefficient relating to a change in characteristics of said at least one control device using the at least one correlation parameter; and air-fuel ratio controlling means for controlling the air-fuel ratio using the air-fuel ratio correction coefficient and the learning correction coefficient.

2. The control system according to claim 1, further comprising abnormality determining means for determining an abnormality in said at least one control device according to the at least one correlation parameter.

3. The control system according to claim 1, wherein said correlation parameter calculating means calculates the at least one correlation parameter when said engine is operating in a predetermined operating condition.

4. The control system according to claim 1, wherein said correlation parameter calculating means calculates a modified air-fuel ratio correction coefficient by modifying the air-fuel ratio correction coefficient with the learning correction coefficient, and calculates the at least one correlation parameter using the modified air-fuel ratio correction coefficient.

5. The control system according to claim 1, wherein said correlation parameter calculating means calculates the at least one correlation parameter using a deviation between the air-fuel ratio correction coefficient and a central value of the air-fuel ratio correction coefficient.

6. The control system according to claim 1, wherein said correlation parameter calculating means uses the sequential statistical processing algorithm, limiting a value of the at least one correlation parameter within a predetermined range.

7. A control system for an internal combustion engine having at least one control device that affects an air-fuel ratio of an air-fuel mixture to be supplied to said engine, said control system comprising:

an air-fuel ratio sensor provided in an exhaust system of said engine;

air-fuel ratio correction coefficient calculating means for calculating an air-fuel ratio correction coefficient for correcting an amount of fuel to be supplied to said engine so that the air-fuel ratio detected by said air-fuel ratio sensor coincides with a target air-fuel ratio;

air-fuel ratio affecting parameter calculating means for calculating an air-fuel ratio affecting parameter indicative of a degree of influence that an operation of said at least one control device exercises upon the air-fuel ratio;

correlation parameter calculating means for calculating at least one correlation parameter which defines a correlation between the air-fuel ratio correction coefficient and the air-fuel ratio affecting parameter using a sequential statistical processing algorithm; and abnormality determining means for determining an abnormality in said at least one control device according to the at least one correlation parameter.

8. A control method for an internal combustion engine having at least one control device that affects an air-fuel ratio of an air-fuel mixture to be supplied to said engine, said control method comprising the steps of:

a) detecting an air-fuel ratio of the air-fuel mixture by an air-fuel ratio sensor provided in an exhaust system of said engine;

b) calculating an air-fuel ratio correction coefficient for correcting an amount of fuel to be supplied to said engine so that the air-fuel ratio detected by said air-fuel ratio sensor coincides with a target air-fuel ratio;

c) calculating an air-fuel ratio affecting parameter indicative of a degree of influence that an operation of said at least one control device exercises upon the air-fuel ratio;

d) calculating at least one correlation parameter which defines a correlation between the air-fuel ratio correction coefficient and the air-fuel ratio affecting parameter using a sequential statistical processing algorithm;

e) calculating a learning correction coefficient relating to a change in characteristics of said at least one control device using the at least one correlation parameter; and f) controlling the air-fuel ratio using the air-fuel ratio correction coefficient and the learning correction coefficient.

9. The control method according to claim 8, further comprising the step of determining an abnormality in said at least one control device according to the at least one correlation parameter.

10. The control method according to claim 8, wherein the at least one correlation parameter is calculated when said engine is operating in a predetermined operating condition.

11. The control method according to claim 8, further comprising the step of calculating a modified air-fuel ratio correction coefficient by modifying the air-fuel ratio correction coefficient with the learning correction coefficient, wherein the at least one correlation parameter is calculated using the modified air-fuel ratio correction coefficient.

12. The control method according to claim 8, the step of calculating the at least one correlation parameter comprises using a deviation between the air-fuel ratio correction coefficient and a central value of the air-fuel ratio correction coefficient.

13. The control method according to claim 8, wherein the step of calculating the at least one correlation parameter using the sequential statistical processing algorithm limits a value of the at least one correlation parameter within a predetermined range.

14. A control method for an internal combustion engine having at least one control device that affects an air-fuel ratio of an air-fuel mixture to be supplied to said engine, said control method comprising the steps of:

a) detecting an air-fuel ratio of the air-fuel mixture by an air-fuel ratio sensor provided in an exhaust system of said engine;

b) calculating an air-fuel ratio correction coefficient for correcting an amount of fuel to be supplied to said engine so that the air-fuel ratio detected by said air-fuel ratio sensor coincides with a target air-fuel ratio;

c) calculating an air-fuel ratio affecting parameter indicative of a degree of influence that an operation of said at least one control device exercises upon the air-fuel ratio;

d) calculating at least one correlation parameter which defines a correlation between the air-fuel ratio correction coefficient and the air-fuel ratio affecting parameter using a sequential statistical processing algorithm; and e) determining an abnormality in said at least one control device according to the at least one correlation parameter.

15. A computer program embodied on a computer-readable medium for causing a computer to carry out a control method for an internal combustion engine having at least one control device that affects an air-fuel ratio of an air-fuel mixture to be supplied to said engine, said control method comprising the steps of:

a) detecting an air-fuel ratio of the air-fuel mixture by an air-fuel ratio sensor provided in an exhaust system of said engine;

b) calculating an air-fuel ratio correction coefficient for correcting an amount of fuel to be supplied to said engine so that the air-fuel ratio detected by said air-fuel ratio sensor coincides with a target air-fuel ratio;

c) calculating an air-fuel ratio affecting parameter indicative of a degree of influence that an operation of said at least one control device exercises upon the air-fuel ratio;

d) calculating at least one correlation parameter which defines a correlation between the air-fuel ratio correction coefficient and the air-fuel ratio affecting parameter using a sequential statistical processing algorithm;

e) calculating a learning correction coefficient relating to a change in characteristics of said at least one control device using the at least one correlation parameter; and f) controlling the air-fuel ratio using the air-fuel ratio correction coefficient and the learning correction coefficient.

16. The computer program according to claim 15, wherein said control method further comprises the step of determining an abnormality in said at least one control device according to the at least one correlation parameter.

17. The computer program according to claim 15, wherein the at least one correlation parameter is calculated when said engine is operating in a predetermined operating condition.

18. The computer program according to claim 15, wherein said control method further comprises the step of calculating a modified air-fuel ratio correction coefficient by modifying the air-fuel ratio correction coefficient with the learning correction coefficient, and the at least one correlation parameter is calculated using the modified air-fuel ratio correction coefficient.

19. The computer program according to claim 15, wherein the step of calculating the at least one correlation parameter comprises using a deviation between the air-fuel ratio correction coefficient and a central value of the air-fuel ratio correction coefficient.

20. The computer program according to claim 15, wherein the step of calculating the at least one correlation parameter using the sequential statistical processing algorithm limits a value of the at least one correlation parameter within a predetermined range.

21. A computer program embodied on a computer-readable medium for causing a computer to carry out a control method for an internal combustion engine having at least one control device that affects an air-fuel ratio of an air-fuel mixture to be supplied to said engine, said control method comprising the steps of:

a) detecting an air-fuel ratio of the air-fuel mixture by an air-fuel ratio sensor provided in an exhaust system of said engine;

b) calculating an air-fuel ratio correction coefficient for correcting an amount of fuel to be supplied to said engine so that the air-fuel ratio detected by said air-fuel ratio sensor coincides with a target air-fuel ratio;

c) calculating an air-fuel ratio affecting parameter indicative of a degree of influence that an operation of said at least one control device exercises upon the air-fuel ratio;

d) calculating at least one correlation parameter which defines a correlation between the air-fuel ratio correction coefficient and the air-fuel ratio affecting parameter using a sequential statistical processing algorithm; and e) determining an abnormality in said at least one control device according to the at least one correlation parameter.

* * * * *